US009803304B2

(12) United States Patent
Obregon et al.

(10) Patent No.: US 9,803,304 B2
(45) Date of Patent: Oct. 31, 2017

(54) AGITATION ELEMENT FOR A WASHING MACHINE APPLIANCE

(71) Applicant: General Electric Company, Schenectady, NY (US)

(72) Inventors: Roberto Obregon, Louisville, KY (US); Bradley Kyle Harris, Shelbyville, KY (US); Randall Winfield Calmeise, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 179 days.

(21) Appl. No.: 14/738,844

(22) Filed: Jun. 13, 2015

(65) Prior Publication Data

US 2016/0362826 A1 Dec. 15, 2016

(51) Int. Cl.

| | |
|---|---|
| ***D06F 13/02*** | (2006.01) |
| ***D06F 17/06*** | (2006.01) |
| ***D06F 17/10*** | (2006.01) |
| ***D06F 21/08*** | (2006.01) |
| ***D06F 23/04*** | (2006.01) |

(52) U.S. Cl.

CPC ..... *D06F 13/02* (2013.01); *D06F 17/06* (2013.01); *D06F 17/10* (2013.01); *D06F 21/08* (2013.01); *D06F 23/04* (2013.01)

(58) Field of Classification Search

CPC ..... D06F 13/02; D06F 17/06; D06F 17/10; D06F 21/08; D06F 23/04; Y10T 74/1526

See application file for complete search history.

(56) References Cited

U.S. PATENT DOCUMENTS

| | | | | | |
|---|---|---|---|---|---|
| 1,814,714 | A * | 7/1931 | Labisky | D06F 13/00 | 366/276 |
| 2,059,183 | A * | 10/1936 | Hume | D06F 13/00 | 220/DIG. 28 |
| 2,089,559 | A * | 8/1937 | Kirby | D06F 13/08 | 366/277 |
| 2,094,559 | A * | 9/1937 | Geldhof | D06F 13/00 | 366/276 |
| 2,208,102 | A * | 7/1940 | Nelson | D06F 13/00 | 68/134 |
| 2,220,476 | A * | 11/1940 | Conterman | D06F 13/00 | 366/278 |
| 2,228,057 | A * | 1/1941 | Kirby | D06F 13/00 | 366/276 |
| 2,253,989 | A * | 8/1941 | Skinner | D06F 13/00 | 366/296 |

(Continued)

*Primary Examiner* — Joseph L Perrin
(74) *Attorney, Agent, or Firm* — Dority & Manning, P.A.

(57) ABSTRACT

A single action agitation element for a washing machine appliance is provided. The agitation element includes a shaft, a first fin, and a second fin. The first fin and second fin each extend outwardly from the shaft and around the shaft. The first fin extends generally in a first fin plane defining an angle greater than zero with a reference plane of the shaft. By contrast, the second fin extends generally in a second fin plane defining an angle less than zero with the reference plane of the shaft. Such a configuration may more efficiently move clothes or other articles within a wash basket of the washing machine appliance downwardly along a vertical direction during certain washing machine operations.

18 Claims, 6 Drawing Sheets

(56) References Cited

U.S. PATENT DOCUMENTS

| | | | | | |
|---|---|---|---|---|---|
| 2,257,932 | A * | 10/1941 | Basler | D06F 13/00 | 68/134 |
| 2,312,541 | A * | 3/1943 | Geldhof | D06F 13/00 | 68/134 |
| 2,990,709 | A * | 7/1961 | Bochan | D06F 13/08 | 68/131 |
| 3,987,651 | A * | 10/1976 | Platt | D06F 13/00 | 366/238 |
| 3,987,652 | A * | 10/1976 | Ruble | D06F 13/00 | 366/238 |
| 4,068,503 | A * | 1/1978 | Platt | D06F 13/00 | 366/243 |
| 4,207,760 | A * | 6/1980 | Bochan | D06F 13/02 | 68/134 |
| 4,693,095 | A * | 9/1987 | Burk | D06F 13/02 | 68/134 |
| 4,718,258 | A * | 1/1988 | Mason | D06F 37/40 | 68/133 |
| 5,784,902 | A * | 7/1998 | Pinkowski | D06F 13/02 | 68/12.02 |
| 7,069,752 | B2 * | 7/2006 | Clark | D06F 39/024 | 192/46 |
| 2014/0096568 | A1 | 4/2014 | Carr et al. | | |

* cited by examiner

AGITATION ELEMENT FOR A WASHING MACHINE APPLIANCE

FIELD OF THE INVENTION

The present subject matter relates generally to washing machine appliances and an agitation element for the same.

BACKGROUND OF THE INVENTION

A vertical axis washing machine appliance generally includes a tub with a basket rotatably positioned within the tub. Articles to be washed, such as clothes, are placed in the machine's basket. A single-action agitation element reciprocates about a vertical axis within the machine's basket. Certain single-action agitation elements include vertically extending ribs providing a pumping action to move the clothing outward from the center of the basket. Other single-action agitation elements include a single rib that spirals around a post of the agitation element to drive the articles downwardly. The surface of the basket and gravity are used in conjunction with these single-action agitation elements to impart a circular motion of the articles, known as "turnover," from a top of the basket, to a bottom of the basket, and back up to the top of the basket.

Regardless, however, such single-action agitation elements do not, for the most part, exhibit good turnover capability due to the generally mediocre ability of gravity alone, or in conjunction with a spiraled rib, to force the articles downwardly along the post. Accordingly, certain washing machine appliances include dual-action agitation elements. Dual-action agitation elements generally include an auger at a basket center that enhances turnover by ratcheting in one direction and actively pulling the clothing downward. However, such dual-action agitation elements are typically more expensive and more complicated to implement.

Additionally, certain of the agitation elements including vertical ribs—single-action and dual-action—can cause wear on the articles being washed due to the articles contacting and interacting with edges of such vertical ribs.

Accordingly, a single-action agitation element capable of providing increased turnover during operation would be useful. More particularly, a single-action agitation element capable of providing increased turnover and reduced wear on the articles being washed would be particularly beneficial.

BRIEF DESCRIPTION OF THE INVENTION

Aspects and advantages of the invention will be set forth in part in the following description, or may be apparent from the description, or may be learned through practice of the invention.

In one exemplary embodiment, a washing machine appliance is provided. The washing machine appliance defines a vertical direction. The washing machine appliance includes a tub, a basket rotatably positioned within the tub, and a single-action agitation element positioned within the basket. The agitation element defines a reference plane perpendicular to the vertical direction and includes a shaft, a first fin, and a second fin. The shaft extends generally along the vertical direction. The first fin and second fin each extend outwardly from the shaft and around the shaft. The first fin defines an angle greater than zero with the reference plane and the second fin defines an angle less than zero with the reference plane.

In another exemplary embodiment, a single-action agitation element is provided for a washing machine appliance defining a vertical direction. The agitation element includes a shaft extending generally along the vertical direction and defines a reference plane perpendicular to the vertical direction. The agitation element also includes a first fin extending outwardly from the shaft and around the shaft, the first fin extending generally in a first fin plane defining an angle greater than zero with the reference plane. The agitation element also includes a second fin extending outwardly from the shaft and around the shaft. The second fin extends generally in a second fin plane defining an angle less than zero with the reference plane such that the second fin plane intersects with the first fin plane.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
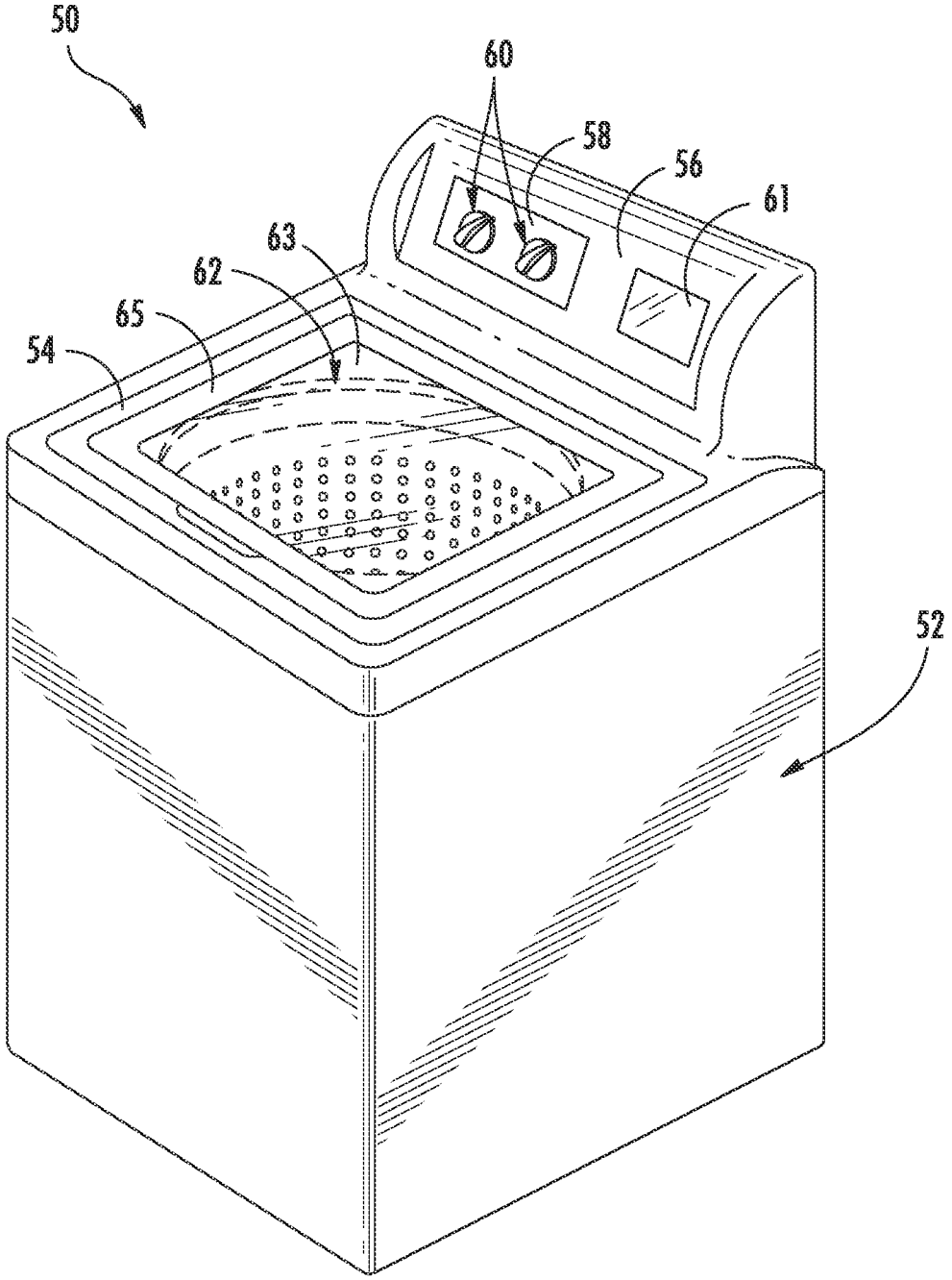
FIG. 1 provides a perspective view of a washing machine appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a perspective view of a washing machine appliance 50 according to an exemplary embodiment of the present subject matter. As may be seen in FIG. 1, washing machine appliance 50 includes a cabinet 52 and a cover 54. A backsplash 56 extends from cover 54, and a control panel 58, including a plurality of input selectors 60, is coupled to backsplash 56.

Control panel 58 and input selectors 60 collectively form a user interface input for operator selection of machine cycles and features, and in one embodiment, a display 61 indicates selected features, a countdown timer, and/or other items of interest to machine users. It should be appreciated, however, that in other exemplary embodiments, the control panel 58, input selectors 60, and display 61, may have any other suitable configuration. For example, in other exemplary embodiments, one or more of the input selectors 60 may be configured as manual "push-button" input selectors, or alternatively may be configured as a touchscreen on, e.g., display 61.

A lid 62 is mounted to cover 54 and is rotatable between an open position (not shown) facilitating access to a tub, also referred to as a wash tub, 64 (FIG. 2) located within cabinet 52 and a closed position (shown in FIG. 1) forming an enclosure over tub 64. Lid 62 in exemplary embodiment includes a transparent panel 63, which may be formed of, for example, glass, plastic, or any other suitable material. The transparency of the panel 63 allows users to see through the panel 63, and into the tub 64 when the lid 62 is in the closed position. In some embodiments, the panel 63 may itself generally form the lid 62. In other embodiments, the lid 62 may include the panel 63 and a frame 65 surrounding and encasing the panel 63. Alternatively, panel 63 need not be transparent.

Figure 2:
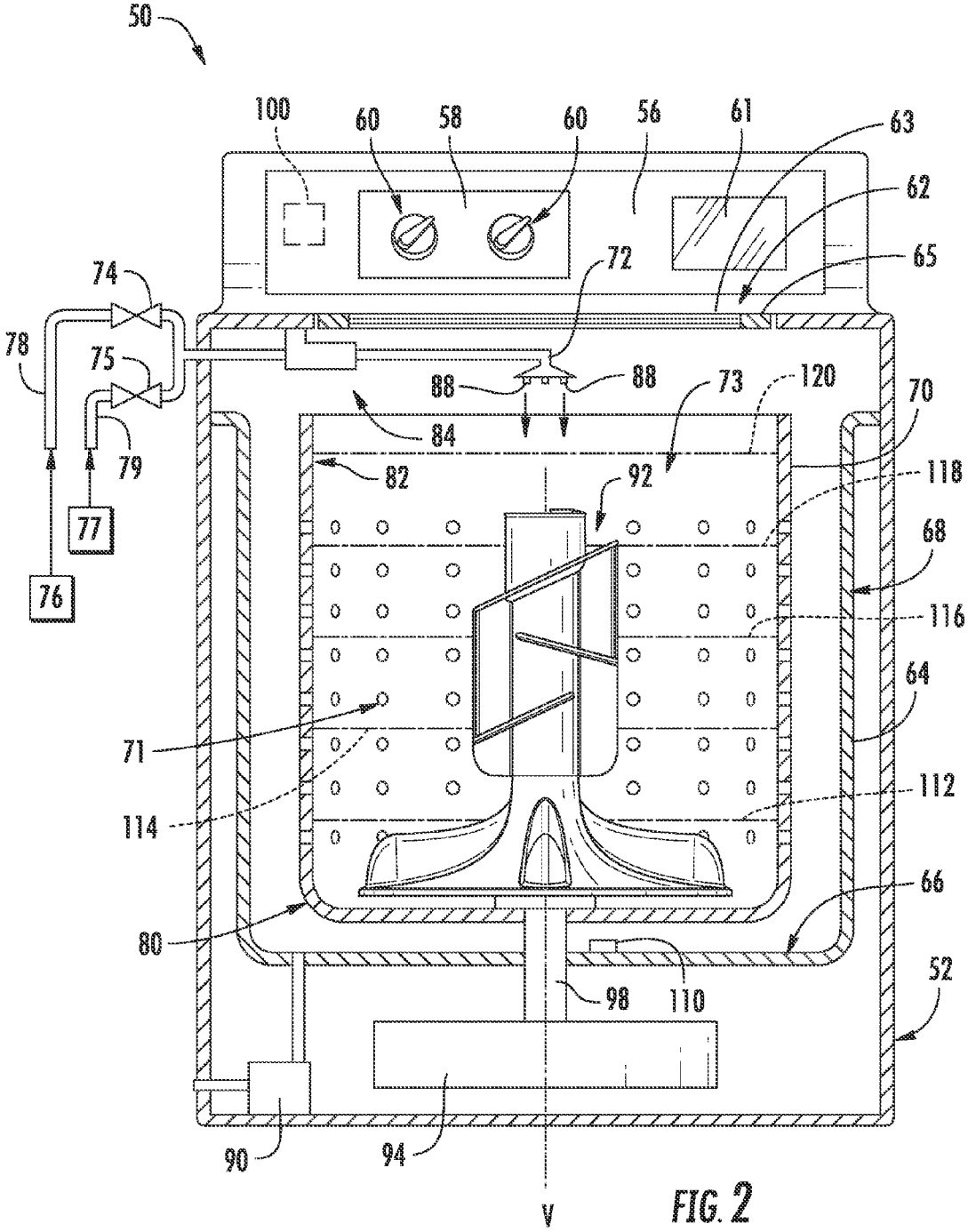
FIG. 2 provides a front, section view of the exemplary washing machine appliance of FIG. 1.

FIG. 2 provides a front, cross-section view of the exemplary washing machine appliance 50 of FIG. 1. As may be seen in FIG. 2, tub 64 includes a bottom wall 66 and a sidewall 68. A wash drum or basket 70 is rotatably mounted within tub 64. In particular, basket 70 is rotatable about a vertical axis V. Thus, washing machine appliance is generally referred to as a vertical axis washing machine appliance. Basket 70 defines a wash chamber 73 for receipt of articles for washing and extends, e.g., vertically, between a bottom portion 80 and a top portion 82. Basket 70 includes a plurality of openings or perforations 71 therein to facilitate fluid communication between an interior of basket 70 and tub 64.

A nozzle 72 is configured for flowing a liquid into tub 64. In particular, nozzle 72 may be positioned at or adjacent to top portion 82 of basket 70. Nozzle 72 may be in fluid communication with one or more water sources 76, 77 in order to direct liquid (e.g. water) into tub 64 and/or onto articles within chamber 73 of basket 70. Nozzle 72 may further include apertures 88 through which water may be sprayed into the tub 64. Apertures 88 may, for example, be tubes extending from the nozzles 72 as illustrated, or simply holes defined in the nozzles 72 or any other suitable openings through which water may be sprayed. Nozzle 72 may additionally include other openings, holes, etc. (not shown) through which water may be flowed, i.e. sprayed or poured, into the tub 64.

Various valves may regulate the flow of fluid through nozzle 72. For example, a flow regulator may be provided to control a flow of hot and/or cold water into the wash chamber of washing machine appliance 50. For the embodiment depicted, the flow regulator includes a hot water valve 74 and a cold water valve 75. The hot and cold water valves 74, 75 are utilized to flow hot water and cold water, respectively, therethrough. Each valve 74, 75 can selectively adjust to a closed position in order to terminate or obstruct the flow of fluid therethrough to nozzle 72. The hot water valve 74 may be in fluid communication with a hot water source 76, which may be external to the washing machine appliance 50. The cold water valve 75 may be in fluid communication with a cold water source 77, which may be external to the washing machine appliance 50. The cold water source 77 may, for example, be a commercial water supply, while the hot water source 76 may be, for example, a water heater. Such water sources 76, 77 may supply water to the appliance 50 through the respective valves 74, 75. A hot water conduit 78 and a cold water conduit 79 may supply hot and cold water, respectively, from the sources 76, 77 through the respective valves 74, 75 and to the nozzle 72.

Moreover, as is shown, the exemplary washing machine appliance defines a plurality of water-fill amounts. At least certain of the water fill amounts may be selected by a user using, e.g., one of input selectors 60. For example, the washing machine appliance 50 depicted defines five water fill amounts—a small water fill amount 112, a medium-low water fill amount 114, a medium-high water fill amount 116, a large water fill amount 118, and an extra-large water fill amount 120. However, in other exemplary embodiments, washing machine appliance 50 may instead define any other suitable number of water fill amounts and/or additional water fill amounts between the depicted amounts. Further, the water fill amounts may be user selectable, or alternatively may be automatically selected by the washing machine appliance 50.

An additive dispenser 84 may additionally be provided for directing a wash additive, such as detergent, bleach, liquid fabric softener, etc., into the tub 64. For example, dispenser 84 may be in fluid communication with nozzle 72 such that water flowing through nozzle 72 flows through dispenser 84, mixing with wash additive at a desired time during operation to form a liquid or wash fluid, before being flowed into tub 64. For the embodiment depicted, nozzle 72 is a separate downstream component from dispenser 84. In other exemplary embodiments, however, nozzle 72 and dispenser 84 may be integral, with a portion of dispenser 84 serving as the nozzle 72, or alternatively dispenser 84 may be in fluid communication with only one of hot water valve 74 or cold water valve 75. In still other exemplary embodiments, the washing machine appliance 50 may not include a dispenser, in which case a user may add one or more wash additives directly to wash chamber 73. A pump assembly 90 (shown schematically in FIG. 2) is located beneath tub 64 and basket 70 for gravity assisted flow to drain tub 64.

As will be described in greater detail below, a single-action agitation element 92 is provided oriented to rotate about the vertical direction V. The single-action agitation element 92 depicted is positioned within the basket 70 to impart motion to the articles and liquid in the chamber 73 of the basket 70. More particularly, the single-action agitation element 92 depicted is provided to impart downward motion of the articles along the vertical direction V. For example, with such a configuration, during operation of the agitation element 92 the articles may be moved downwardly along the vertical direction V at a center of the basket 70, outwardly from the center of basket 70 at the bottom portion 80 of the basket 70, then upwardly along the vertical direction V towards the top portion 82 of the basket 70.

For the embodiment depicted, the basket 70 and agitation element 92 are driven by a motor 94, such as a pancake motor. As motor output shaft 98 is rotated, basket 70 and agitation element 92 are operated for rotatable movement within tub 64, e.g., about vertical axis V. Washing machine appliance 50 may also include a brake assembly (not shown) selectively applied or released for respectively maintaining basket 70 in a stationary position within tub 64 or for allowing basket 70 to spin within tub 64.

Various sensors may additionally be included in the washing machine appliance 50. For example, a pressure sensor 110 may be positioned in the tub 64 as illustrated or, alternatively, may be remotely mounted in another location within the appliance 50 and be operationally connected to tub 64 by a hose (not shown). Any suitable pressure sensor 110, such as an electronic sensor, a manometer, or another suitable gauge or sensor, may be utilized. The pressure sensor 110 may generally measure the pressure of water in the tub 64. This pressure can then be utilized to estimate the height or amount of water in the tub 64. Additionally, a suitable speed sensor can be connected to the motor 94, such as to the output shaft 98 thereof, to measure speed and indicate operation of the motor 94. Other suitable sensors, such as temperature sensors, water/moisture sensors, etc., may additionally be provided in the washing machine appliance 50.

Operation of washing machine appliance 50 is controlled by a processing device or controller 100, that is operatively coupled to the input selectors 60 located on washing machine backsplash 56 (shown in FIG. 1) for user manipulation to select washing machine cycles and features. Controller 100 may further be operatively coupled to various other components of appliance 50, such as the flow regulator (including valves 74, 75), motor 94, pressure sensor 110, other suitable sensors, etc. In response to user manipulation of the input selectors 60, controller 100 may operate the various components of washing machine appliance 50 to execute selected machine cycles and features.

While described in the context of specific embodiments of washing machine appliance 50, using the teachings disclosed herein it will be understood that washing machine appliance 50 is provided by way of example only. Other washing machine appliances having different configurations (such as horizontal-axis washing machine appliances), different appearances, and/or different features may also be utilized with the present subject matter as well.

Figure 3:
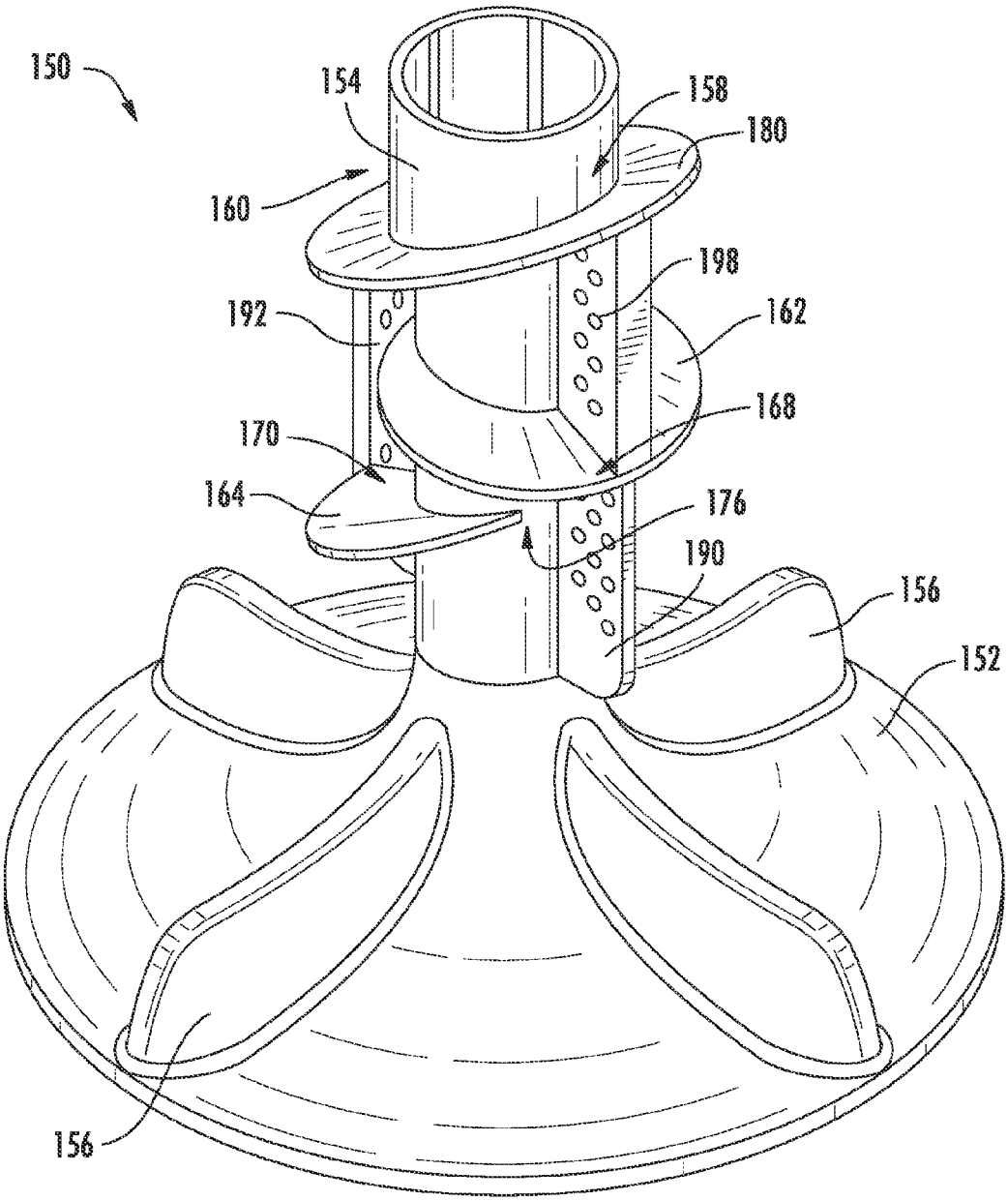
FIG. 3 provides a perspective view of an agitation element in accordance with an exemplary embodiment of the present disclosure.
Figure 4:
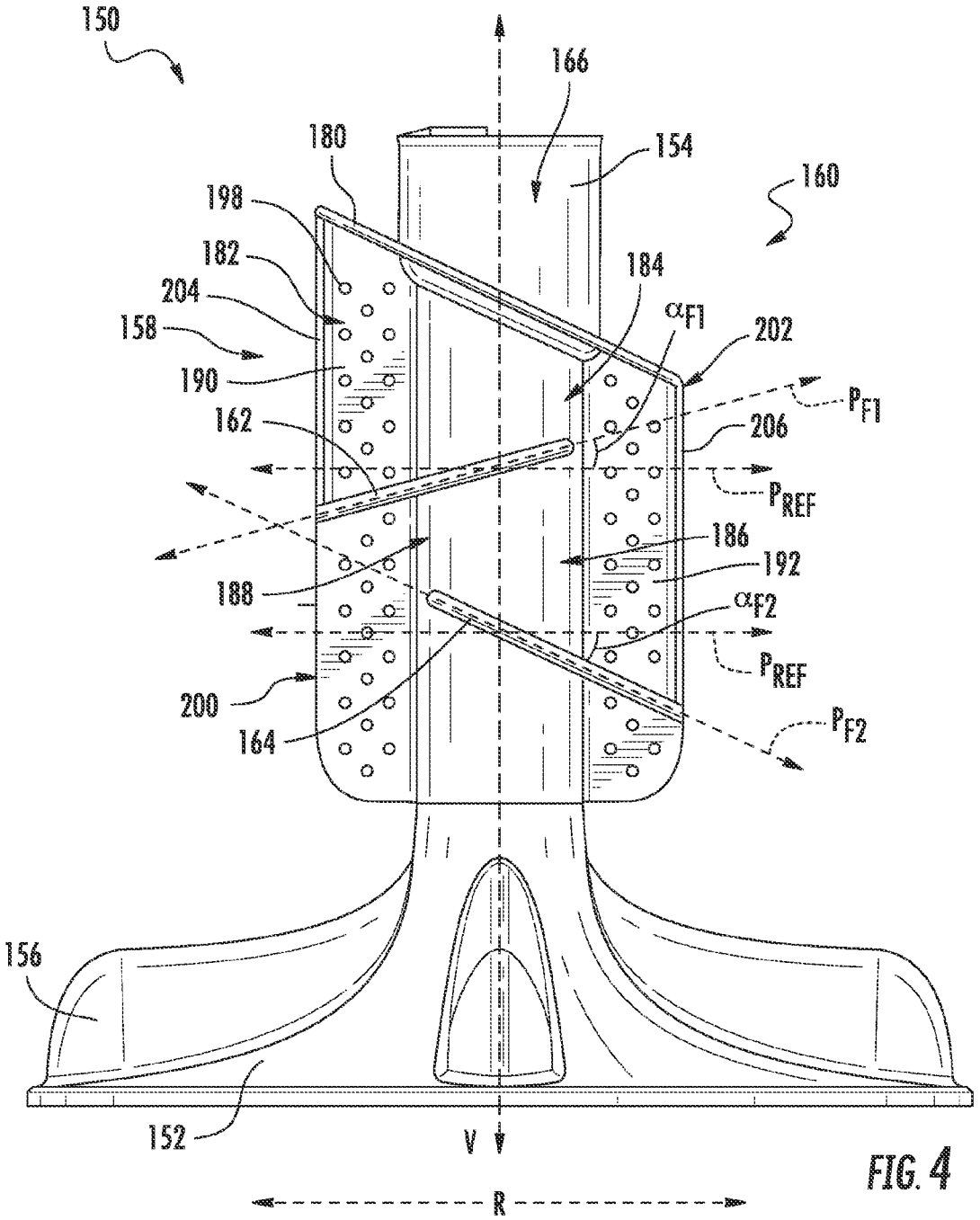
FIG. 4 provides a front elevation view of the exemplary agitation element of FIG. 3.

Referring now to FIGS. 3 and 4, a perspective view and an elevation view are provided of an agitation element 150 in accordance with an exemplary embodiment of the present disclosure are provided. In certain exemplary embodiments, the agitation element 150 depicted in FIGS. 3 and 4 may be the same agitation element 92 depicted above in FIG. 2.

As shown, the agitation element 150 includes a base 152 and a shaft 154, the shaft 154 extending generally along the vertical direction V. Along the base 152, the agitation element 150 includes a plurality of ribs 156 extending outwardly generally along a radial direction R. Additionally, the agitation element 150 includes a plurality of fins extending outwardly from the shaft 154 and a plurality of support plates also extending outwardly from the shaft 154 (each described in greater detail below). The shaft 154 of the agitation element 150 generally defines a first side 158 and an opposite second side 160, and is formed integrally such that the shaft 154 may only rotate about the vertical direction V as a single unit. Additionally, in certain exemplary embodiments, one or more of the fins and one or more of the support plates may also be formed integrally with the shaft 154. For example, in certain exemplary embodiments, the shaft 154 and one or more of the fins and support plates may be formed integrally by injection molding.

More particularly, for the exemplary embodiment depicted, the agitation element 150 includes a first fin 162 and a second fin 164. The first fin 162 and second fin 164 each extend around the shaft 154 and outwardly from the shaft 154, angled up or down relative to the radial direction R. Particularly for the embodiment depicted, the shaft 154 defines a reference plane $P_R$ perpendicular to the vertical direction V. The first fin 162 defines an angle $\alpha_{F1}$ greater than zero with the reference plane $P_R$ and the second fin 164 defines an angle $\alpha_{F2}$ less than zero with the reference plane $P_R$. More specifically, the first fin 162 defines an angle $\alpha_{F1}$ greater than zero with the reference plane $P_R$ as viewed from a front 166 of the agitation element 150 (i.e., FIG. 4), and viewed from left to right (i.e., first side 158 to second side 160). Similarly, the second fin 164 defines an angle $\alpha_{F2}$ less than zero with the reference plane $P_R$ also viewed from the front 166 of the agitation element 150 (i.e., FIG. 4), and viewed from left to right (i.e., first side 158 to second side 160). By way of further explanation, the first fin 162 extends generally in a first fin plane $P_{F1}$ and the second fin 164 extends generally in a second fin plane $P_{F2}$. The first fin plane $P_{F1}$ defines an angle $\alpha_{F1}$ greater than zero with the reference plane $P_R$ and the second fin plane $P_{F1}$ defines an angle $\alpha_{F2}$ less than zero with the reference plane $P_R$. Accordingly, the second fin plane $P_{F1}$ intersects with the first fin plane $P_{F1}$.

In certain exemplary embodiments, the angle $\alpha_{F1}$ defined between the first fin plane $P_{F1}$ and the reference plane $P_R$ may be between about ten (10) degrees and about sixty (60) degrees. For example, the angle $\alpha_{F1}$ defined between the first fin plane $P_{F1}$ and a reference plane $P_R$ may be between about fifteen (15) degrees and about forty-five (45) degrees, such as between about twenty (20) degrees and about thirty (30) degrees. By contrast, the angle $\alpha_{F2}$ defined between the second fin plane $P_{F1}$ and a reference plane $P_R$ may be between about minus ten (−10) degrees and about minus sixty (−60) degrees. For example, the angle $\alpha_{F2}$ defined between the second fin plane $P_{F1}$ and a reference plane $P_R$ may be between about minus fifteen (−15) degrees and about minus forty-five (−45) degrees, such as between about minus twenty (−20) degrees and about minus thirty (−30) degrees. It's be appreciated, as used herein, terms of approximation, such as, "about" and "approximately," refer to being within a 10 percent margin of error.

Figure 5:
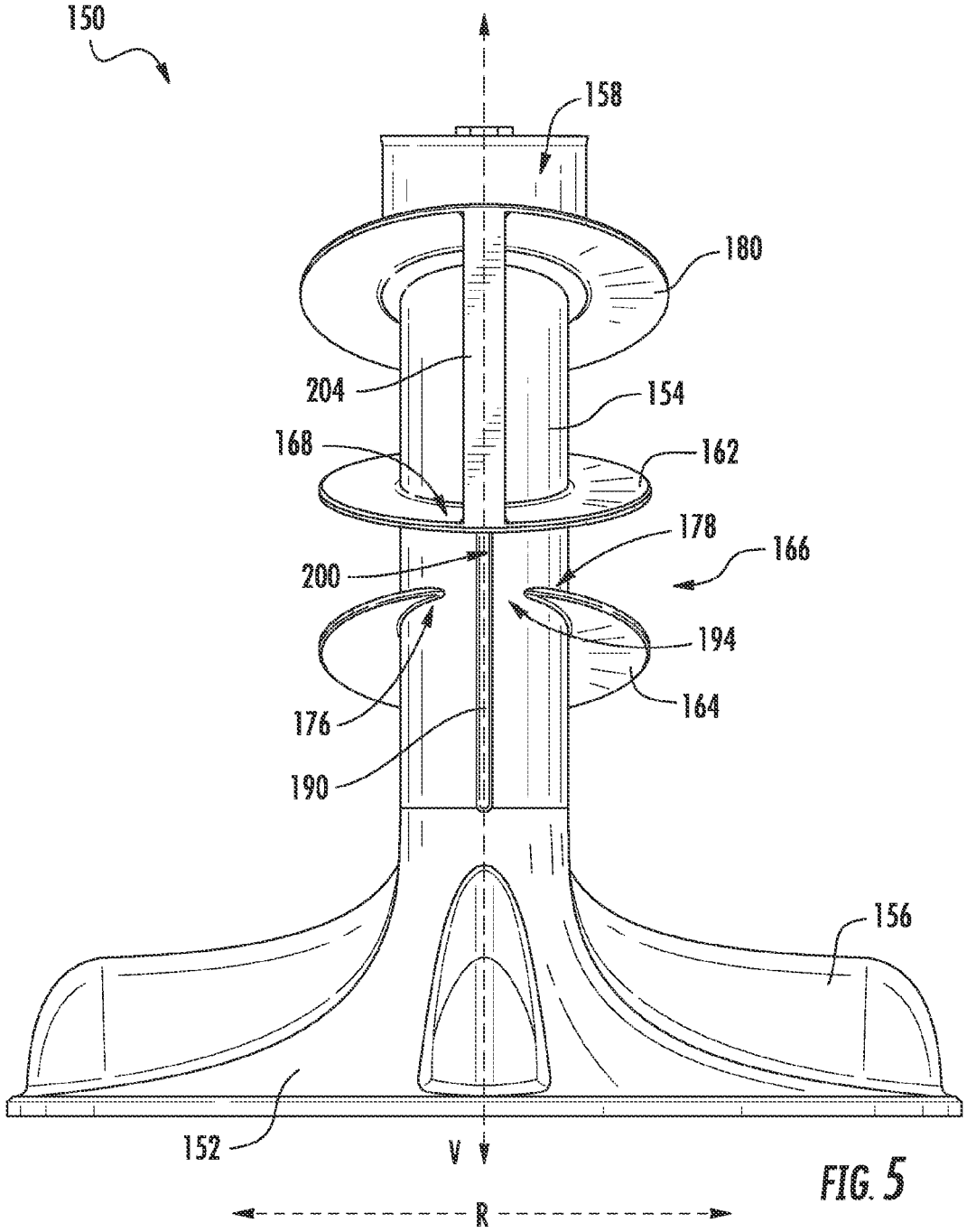
FIG. 5 provides a first side view of the exemplary agitation element of FIG. 3.
Figure 6:
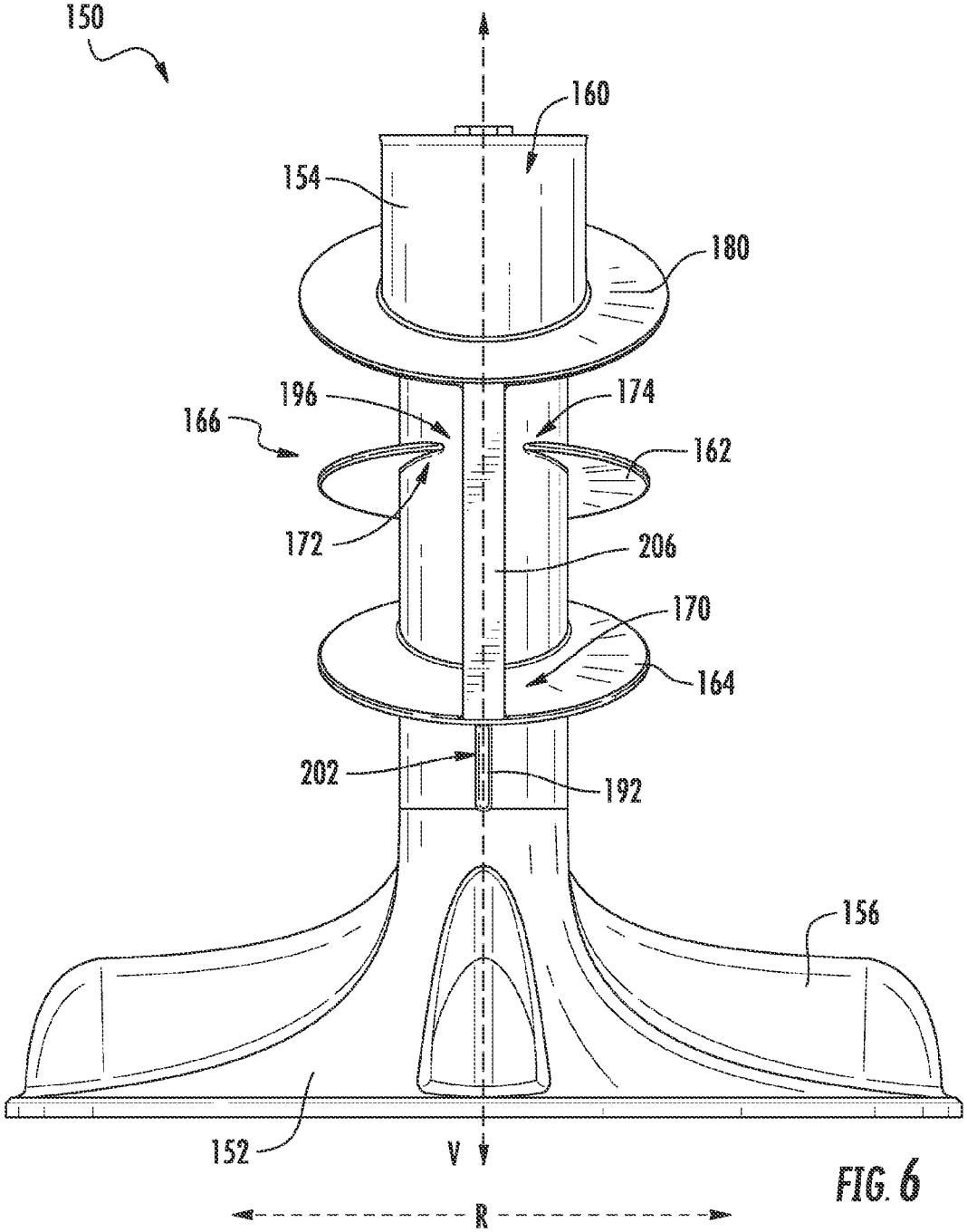
FIG. 6 provides a second side view of the exemplary agitation element of FIG. 3.

Referring now also to FIGS. 5 and 6, for the embodiment depicted, the first fin 162 and the second fin 164 each extend less than about 360 degrees around the shaft 154. FIG. 5 provides an elevation view of the agitation element 150 viewing the first side 158 of the shaft 154, and FIG. 6 provides an elevation view of the agitation element 150 viewing the second side 160 of the shaft 154.

As shown, the first fin 162 and the second fin 164 each include at least one end portion and a middle portion 168, 170, respectively. For example, referring particularly to FIG. 6, the at least one end portion of the first fin 162 includes a first end 172 and a second end 174. The first and second ends 172, 174 of the first fin 162 each gradually terminate into the shaft 154. More particularly, the first and second ends 172, 174 of the first fin 162 each define a radius along the radial direction R that approaches zero as the respective end 172, 174 terminates into the shaft 154. Similarly, referring now particularly to FIG. 5, the at least one end portion of the second fin 164 also includes a first end 176 and a second end 178. The first and second ends 176, 178 of the second fin 164 also gradually terminate into the shaft 154. More particularly, the first and second ends 176, 178 of the second fin 164 each define a radius along the radial direction R that also approaches zero as the respective end terminates into the shaft 154.

Notably, the agitation element 150 further includes a top plate 180 extending outwardly from the shaft 154 in a direction substantially parallel to the second fin plane $P_{F1}$. The top plate 180, in contrast with the first fin 162 and the second fin 164, extends 360 degrees around the shaft 154. Referring particularly to FIG. 4, the middle portion 168 of the first fin 162 defines an upper inlet gap 182 with the top plate 180 along the vertical direction V, and the first and second ends 172, 174 of the first fin 162 each define an upper outlet gap 184 with the top plate 180 along the vertical direction V. Similarly, the first and second ends 172, 174 of the first fin 162 each define a lower inlet gap 186 with the second fin 164 along the vertical direction V, and the first and second ends 176, 178 of the second fin 164 each define a lower outlet gap 188 with the first fin 162 also along the vertical direction V. The inlet gaps 182, 186 are larger than the respective outlet gaps 184, 188.

Such a configuration may assist the agitation element 150 in forcing articles within a basket downwardly along the vertical direction V during certain operations of a washing machine appliance. More particularly, during certain operations of a washing machine appliance, the agitation element 150 may be rotated about the vertical direction V approximately 180 degrees in a first direction, then approximately 180 degrees in a second and opposite direction. During such oscillations, the articles may be woven downwardly along the agitation element 150. For example, in an exemplary wash cycle, the agitation element 150 may first be rotated in the first direction. Articles starting in the upper inlet gap 182 between the top plate 180 and the first fin 162 may be moved from the upper inlet gap 182 into and through the upper outlet gap 184 between the top plate 180 and the first fin 162. Such articles may then be positioned in or proximate to the lower inlet gap 186 between the first fin 162 and the second fin 164. Once the agitation element 150 is subsequently rotated in the second in the opposite direction, such articles positioned in or proximate to the lower inlet gap 186 between the first fin 162 and the second fin 164 may be pressed downwardly by a bottom side of the first fin 162 into and through the lower outlet gap 188 between the first fin 162 and second fin 164. Subsequently, articles having passed through the lower outlet gap 188 between the first fin 162 and second fin 164 may be pressed downwardly by a bottom side of the second fin 164 as the agitation element 150 is again rotated in the first direction. Finally, the ribs 156 extending outwardly generally along the radial direction R along the base 152 of the agitation element 150 may move the articles outwardly generally along the radial direction R within the basket towards a sidewall of the basket. The articles may subsequently move upwardly along the vertical direction V along the side wall the basket, completing a rotation of the articles, i.e. "turnover." Such a configuration may more effectively move articles within the wash basket downwardly along the vertical direction V along the shaft 154. Accordingly, such configuration may increase a turnover of the articles within the wash basket of the wash machine appliance, allowing for greater cleaning of such articles.

As stated, the agitation element 150 further includes a plurality of support plates. More particularly, the agitation element 150 depicted includes a first support plate 190 and a second support plate 192. The first support plate 190 extends outwardly from the shaft 154 at the first side 158 of the shaft 154 and generally along the vertical direction V. For example, in the embodiment depicted, the first support plate 190 extends from the top plate 180 to the middle portion 168 of the first fin 162, and from the middle portion 168 of the first fin 162 downwardly along the vertical direction V towards the base 152. Additionally, the second support plate 192 similarly extends outwardly from the shaft 154 at the second side 160 of the shaft 154 and generally along the vertical direction V. For example, in the embodiment depicted, the second support plate 192 extends from the top plate 180 to the middle portion 170 of the second fin 164 and from the middle portion 170 of the second fin 164, downwardly along the vertical direction V towards the base 152. Notably, the first support plate 190 extends through a gap 194 (FIG. 5) between the first and second ends 176, 178 of the second fin 164, and the second support plate 192 extends through a gap 196 (FIG. 6) between the first and second ends 172, 174 of the first fin 162.

The first and second support plates 190, 192 may provide structural support to the top plate 180, first fin 162, and second fin 164. Notably, the additional structural support provided to the top plate 180, first fin 162, and second fin 164 may allow for a reduced diameter of the shaft 154 of the agitation element 150. Accordingly, such a configuration may allow for an increased usable volume within the basket of the washing machine appliance.

Additionally, the first and second support plates 190, 192 may assist in urging articles from the upper and lower inlet gaps 184, 186 into and through the upper and lower outlet gaps 186, 188. In order to further assist in urging articles from the upper and lower inlet gaps 182, 186 into and through the upper and lower outlet gaps 184, 188, the first and second support plates 190, 192 each include a plurality of pores 198 to allow a flow of water therethrough. Such a configuration may decrease a drag generated by the first and second support plates 190, 192 while the agitation element 150 is oscillated, and may also reduce an amount of turbulence generated in the wash liquid during oscillation of the agitation element 150.

Referring still to FIGS. 3 through 6, the first support plate 190 defines an outer edge 200 along the radial direction R and the second support plate 192 similarly defines an outer edge 202 along the radial direction R. Additionally, the exemplary agitation element 150 depicted further includes a first lip 204 extending approximately perpendicularly from the first support plate 190 at the outer edge 200 of the first support plate 190 and a second lip 206 extending approximately perpendicularly from the second support plate 192 at the outer edge 202 of the second support plate 192. More particularly, for the embodiment depicted, the first lip 204 extends perpendicularly from the first support plate 190 at the outer edge 200 of the first support plate 190 between the top plate 180 and the middle portion 168 of the first fin 162 and the second lip 206 extends perpendicularly from the second support plate 192 at the outer edge 202 of the second support plate 192 between the top plate 180 and the middle portion 170 of the second fin 164.

For the embodiment depicted, the first and second lips 204, 206 each define a width of at least about one half of an inch. It should be appreciated, however, that in other exemplary embodiments, the first and second lips 24, 206 may alternatively define any other suitable width. For example, in certain exemplary embodiments, one or both of the first and second lips 204, 206 may define a width of at least about three quarters of an inch, or at least about one inch. The first and second lips 204, 206 extending perpendicularly from the first and second plates 190, 192, respectively, may assist other elements of the agitation element 150 in urging the articles downwardly along the vertical direction V. Additionally, the first and second lips 204, 206 may provide an increased surface area for urging the articles downwardly along the vertical direction V at the outer edges 200, 202 of the first and second plates 190, 12. Accordingly, such a configuration may reduce an amount of wear on the articles during certain operations of the wash machine appliance.

It should be appreciated, that the agitation element 150 depicted in FIGS. 3 through 6 is provided by way of example only and that in other exemplary embodiments, such agitation element 150 may include any other suitable configuration. For example, in other exemplary embodiments, the agitation element 150 may include any other suitable number of fins and/or support plates. For example, in other exemplary embodiments, the agitation element 150 may be included at least three fins, at least four fins, or at least six fins. Additionally, in still other exemplary embodiments, the agitation element 150 may not include one or both of the first support plate 190 or the second support plate 192. Alternatively, other exemplary agitation elements may include any other suitable number of support plates positioned in any other suitable manner. Further, although the exemplary agitation element 150 depicted includes pores 198 in the first and second support plates 190, 192 and the first and second lips 204, 206 extending from the outer edges 200, 202 of the first and second support plates 190, 192, other exemplary embodiments may not include one or both of these features.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance defining a vertical direction, the washing machine appliance comprising:

a tub;

a basket rotatably positioned within the tub;

a single-action agitation element positioned within the basket, the agitation element defining a reference plane perpendicular to the vertical direction, the agitation element including a shaft, a first fin, and a second fin, the shaft extending generally along the vertical direction, the first fin and second fin each extending outwardly from the shaft and around the shaft, the first fin defining an angle greater than zero with the reference plane and the second fin defining an angle less than zero with the reference plane; and a first support plate extending outwardly from the shaft and generally along the vertical direction, wherein the first fin includes at least one end portion and a middle portion, and wherein the first support plate intersects the first fin at the middle portion.

2. The washing machine appliance of claim 1, wherein the first fin and the second fin each extend less than 360 degrees around the shaft.

3. The washing machine appliance of claim 1, wherein the at least one end portion of the fin defines a radius that approaches zero as it terminates into the shaft, wherein the second fin also includes at least one end portion and a middle portion, and wherein the at least one end portion of the first fin defines a radius that also approaches zero as it terminates into the shaft.

4. The washing machine appliance of claim 1, wherein the first support plate defines a plurality of pores to allow a flow of water therethrough.

5. The washing machine appliance of claim 1, wherein the washing machine appliance defines a radial direction, wherein the first support plate defines an outer end along the radial direction, and wherein the agitation element further includes a lip extending approximately perpendicularly from the first support plate at the outer end of the first support plate.

6. The washing machine appliance of claim 5, wherein the lip defines a width of at least about three quarters of an inch.

7. The washing machine appliance of claim 1, wherein the agitation element further includes a top plate extending in a direction substantially parallel to the second fin.

8. The washing machine appliance of claim 1, wherein the shaft of the agitation element is formed integrally such that the shaft may only rotate about the vertical direction as a single unit.

9. The washing machine appliance of claim 1, wherein the washing machine appliance defines a radial direction, wherein the agitation element further includes a base, and wherein the base defines a plurality of ribs extending outwardly generally along the radial direction.

10. A single-action agitation element for a washing machine appliance defining a vertical direction, the agitation element comprising:

a shaft extending generally along the vertical direction and defining a reference plane perpendicular to the vertical direction;

a first fin extending outwardly from the shaft and around the shaft, the first fin extending generally in a first fin plane defining an angle greater than zero with the reference plane; and a second fin also extending outwardly from the shaft and around the shaft, the second fin extending generally in a second fin plane defining an angle less than zero with the reference plane such that the second fin plane intersects with the first fin plane; and a first support plate extending outwardly from the shaft and generally along the vertical direction, wherein the first fin includes at least one end portion and a middle portion, and wherein the first support plate intersects the first fin at the middle portion.

11. The agitation element of claim 10, wherein the first fin and the second fin each extend less than 360 degrees around the shaft.

12. The agitation element of claim 10, wherein the at least one end portion of the fin defines a radius that approaches zero as it terminates into the shaft, wherein the second fin also includes at least one end portion and a middle portion, and wherein the at least one end portion of the first fin defines a radius that also approaches zero as it terminates into the shaft.

13. The agitation element of claim 12, wherein the shaft defines a first side and an opposite second side, wherein the at least one end portion of the first fin and the middle portion of the second fin are each positioned proximate to the first side of the shaft, and wherein the at least one end portion of the second fin and the middle portion of the first fin are positioned proximate to the second side of the shaft.

14. The agitation element of claim 12, wherein the at least one end portion of the first fin defines a beginning gap with the second fin along the vertical direction, wherein the at least one end portion of the second fin defines an ending gap with the first fin along the vertical direction, and wherein the beginning gap is larger than the ending gap.

15. The agitation element of claim 10, wherein the first support plate defines a plurality of pores to allow a flow of water therethrough.

16. The agitation element of claim 10, wherein the washing machine appliance defines a radial direction, wherein the first support plate defines an outer end along the radial direction, and wherein the agitation element further includes a lip extending approximately perpendicularly from the first support plate at the outer end of the first support plate.

17. The agitation element of claim 16, wherein the lip defines a width of at least about one inch.

18. The agitation element of claim 10, wherein the shaft of the agitation element is formed integrally such that the shaft may only rotate about the vertical direction as a single unit.

* * * * *